US006227945B1

(12) United States Patent
Takahashi et al.

(10) Patent No.: US 6,227,945 B1
(45) Date of Patent: May 8, 2001

(54) METHOD AND APPARATUS FOR POLISHING THE OUTER PERIPHERY OF DISC-SHAPED WORKPIECE

(75) Inventors: Shuzo Takahashi, Kodaira; Toshihiko Hirabayashi, Higashikurume, both of (JP)

(73) Assignee: Kyokuei Kenmakako Kabushiki Kaisha (JP)

( * ) Notice: Subject to any disclaimer, the term of this patent is extended or adjusted under 35 U.S.C. 154(b) by 0 days.

(21) Appl. No.: 09/316,785

(22) Filed: May 21, 1999

(51) Int. Cl.[7] ..... B24B 9/06
(52) U.S. Cl. ..... 451/44; 451/108
(58) Field of Search ..... 451/44, 180, 292, 451/66, 256, 43; 409/143; 144/49

(56) References Cited

U.S. PATENT DOCUMENTS 5,404,678 * 4/1995 Hasegawa et al. ..... 451/180
5,547,415 * 8/1996 Hasegawa et al. ..... 451/480

FOREIGN PATENT DOCUMENTS 64-71656 3/1989 (JP) .
64-71657 3/1989 (JP) .
740214 2/1995 (JP) .
7164291 6/1995 (JP) .

* cited by examiner

*Primary Examiner*—Joseph J. Hail, III
*Assistant Examiner*—George Nguyen
(74) *Attorney, Agent, or Firm*—Hayes, Soloway, Hennessey, Grossman & Hage, P.C.

(57) ABSTRACT

The outer periphery of a workpiece (semiconductor wafer) 42 is caused to come into contact with an abrasive material (abrasive cloth) 28 in a cylindrical polishing drum 23, and the polishing drum 23 and the workpiece 42 are relatively rotated, whereby the region where the outer periphery of the workpiece is in contact with the abrasive cloth 28 is increased and a polishing effect can be increased.

14 Claims, 7 Drawing Sheets

METHOD AND APPARATUS FOR POLISHING THE OUTER PERIPHERY OF DISC-SHAPED WORKPIECE

BACKGROUND OF THE INVENTION

1. Field of the Invention

The present invention relates to a method and apparatus for mirror-polishing, for example, the outer periphery of a disc-shaped semiconductor wafer and the chamfered portion of the outer periphery of the wafer.

2. Description of the Related Art

Disc-shaped semiconductor silicon wafers (hereinafter, referred to as semiconductor wafers) having a relatively large diameter are subjected to mirror-polishing not only on the surface of them but also on the outer periphery thereof and on the chamfered portion formed to the outer periphery in a manufacturing process, and the reduction of the yield of the wafers due to powder dust deposited on them is prevented thereby.

The outer periphery of wafers has been mirror-polished by the method disclosed in, for example, Japanese Unexamined Patent Publication No. 64-71656 or Japanese Unexamined Patent Publication No. 64-71657.

That is, the chamfered portion of the outer periphery of a semiconductor wafer is mirror-polished in such a manner that the semiconductor wafer is held with a suction chuck or the like and the chamfered portion is pressed against the outer periphery of a polishing drum having an abrasive cloth wound around the surface thereof while rotating the polishing drum at a prescribed speed.

In the above conventional mirror-polishing method, however, there is a problem that a long time is required for the mirror polishing and working efficiency is low because the chamfered portion of the outer periphery of the semiconductor wafer is in line-contact with the abrasive cloth wound around the polishing drum and it is polished under conditions wherein the contact region of the wafer is very narrow.

Further, when the outer periphery of the semiconductor wafer has chamfered portions on both the sides thereof, it is impossible to polish both sides at once. Therefore, after one of the chamfered portions is polished, the semiconductor wafer must be removed from the suction chuck and the other of the chamfered portions must be polished after the semiconductor wafer is reversed and rechucked, which is a troublesome job and by which productivity is lowered.

An object of the present invention, which was made to solve these problems, is to provide a polishing method and apparatus for polishing the outer periphery of a disc-shaped workpiece in order to increase polishing efficiency and to greatly improve productivity by increasing the region where the outer periphery of the workpiece is in contact with an abrasive cloth as well as by continuously and easily polishing a chamfered portion, even if the workpiece has the chamfered portion on both the sides of it.

SUMMARY OF THE INVENTION

To achieve the above object, a polishing method of the present invention is characterized in that a disc-shaped workpiece supported by a support shaft is accommodated in a cylindrical polishing drum having an abrasive material disposed to the inner periphery of it and the outer periphery of the workpiece is polished by relatively rotating the polishing drum and the workpiece while causing at least a part of the outer periphery of the workpiece to come into contact with the abrasive material.

In the above method, it is preferable that the outer periphery of the workpiece is polished while relatively moving the polishing drum and the workpiece in the axial direction of the polishing drum.

In the above method, it is preferable that any one of the axial line of the polishing drum and the workpiece support shaft is tilted with respect to the other of them a prescribed angle so that the outer periphery of the workpiece alternately comes into contact with both the inner peripheries of the abrasive material which confront each other at approximately 180°.

In the above method, it is preferable that the outer periphery of the workpiece is polished by alternately tilting any one of the axial line of the polishing drum and the workpiece support shaft with respect to the other of them a prescribed angle.

In the above method, it is preferable that the outer periphery of the workpiece is polished by tilting any one of the axial line of the polishing drum and the workpiece support shaft so that a part of the outer periphery of the workpiece is in plane contact with the abrasive material.

To achieve the above object, a polishing apparatus of the present invention for polishing the outer periphery of a disc-shaped workpiece is characterized by comprising a cylindrical polishing drum having an abrasive material disposed to the inner periphery of it, a workpiece holding member attached to support shaft so that it can be inserted into and removed from the polishing drum; and a drive means for relatively rotating any one of at least the polishing drum and the workpiece holding member.

In the above apparatus, it is preferable to provide a moving means for relatively moving any one of the polishing drum and the support shaft in the axial direction of the polishing drum.

In the above apparatus, it is preferable to provide a second moving means for relatively moving any one of the polishing drum and the support shaft in a direction perpendicular to the axis of the polishing drum.

In the above apparatus, it is preferable to provide a rotating means for relatively horizontally rotating any one of the polishing drum and the support shaft.

In the above apparatus, it is preferable that the abrasive material disposed to the inner periphery of the polishing drum has an inner peripheral shape having a small diameter on both the ends of it and a large diameter at the central portion of it.

In the above apparatus, it is preferable that the abrasive material disposed to the inner periphery of the polishing drum has an inner periphery formed to a waveform.

According to the polishing method and apparatus of the present invention, the outer periphery of the workpiece is caused to come into contact with the abrasive material in the cylindrical polishing drum, and the polishing drum and the workpiece are relatively rotated, whereby the region where the outer periphery of the workpiece is in contact with the abrasive cloth is increased and the polishing effect can be increased.

DESCRIPTION OF THE PREFERRED EMBODIMENTS

Embodiments of the present invention will be described below with reference to the accompanying drawings.

Figure 1:
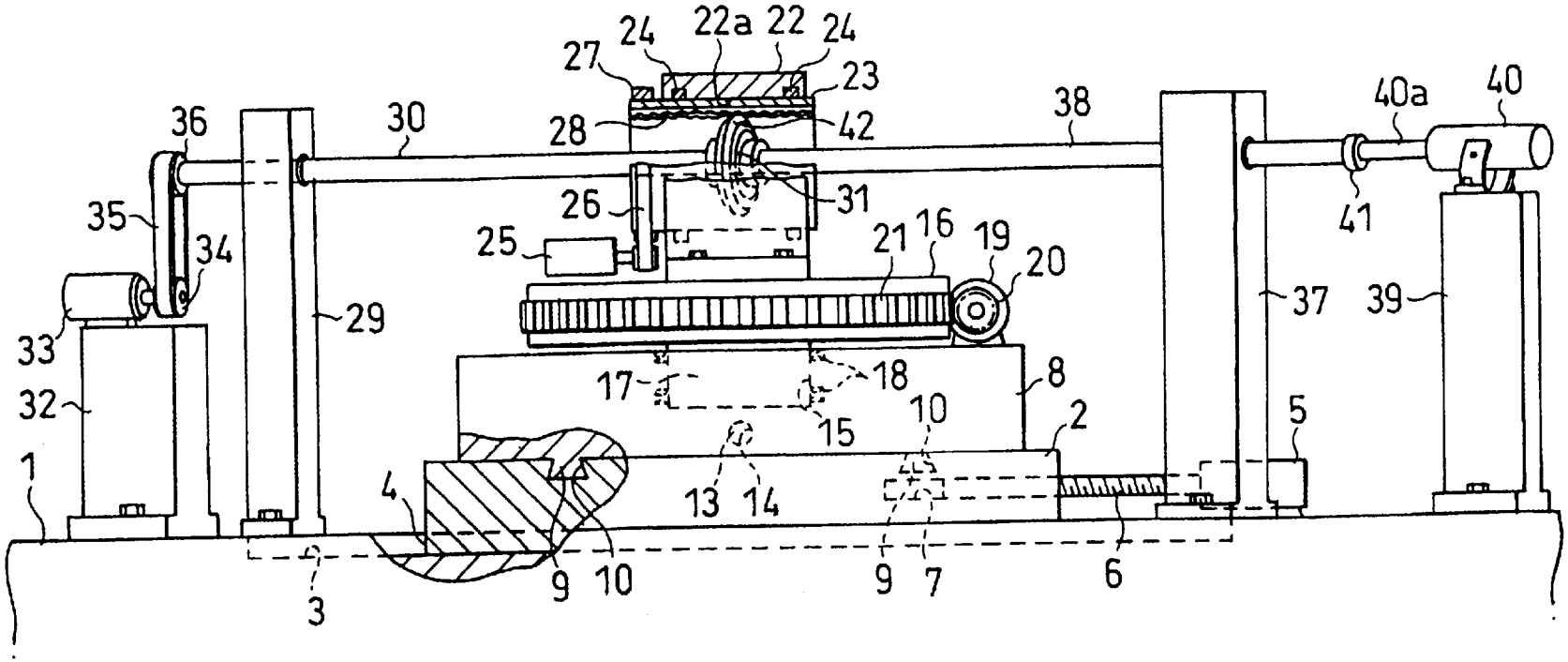
FIG. 1 is a front elevational view, partly in cross section, of a polishing apparatus of the present invention.
Figure 2:
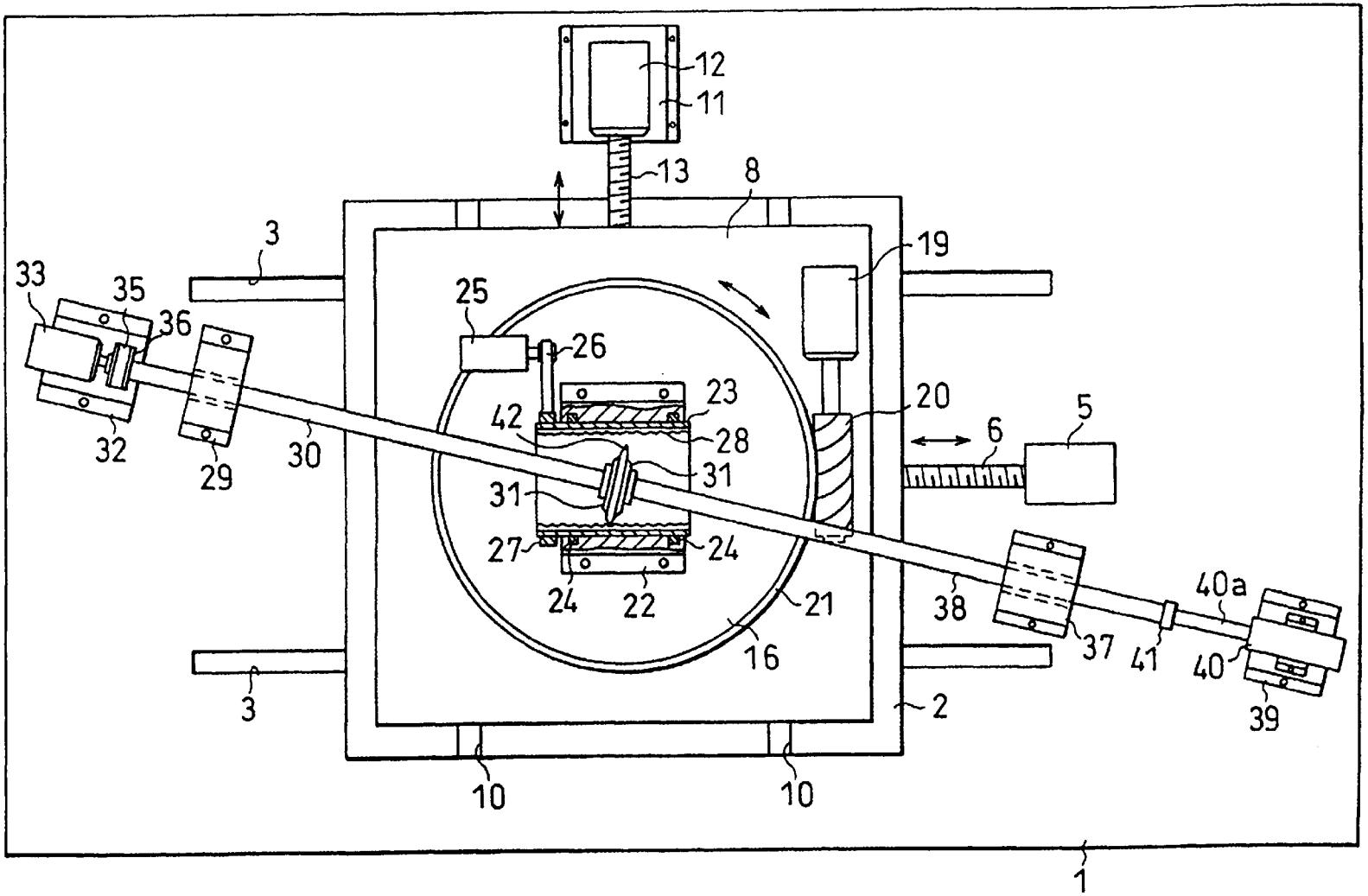
FIG. 2 is a plan view of the polishing apparatus of the present invention.

FIG. 1 and FIG. 2 show a polishing apparatus of the present invention, wherein a right and left moving table 2 is placed on a base 1 at the upper central portion thereof so as to be slidingly moved in such a manner that a projection 4 formed on the lower surface of a moving table 2 is engaged with a concave groove 3 formed on the upper surface of the base 1 (hereinafter, directions are defined as the directions on the drawings).

A first step motor 5 is disposed on the base 1 on the right side of the right and left moving table 2. A screw shaft 6, which is coupled with the rotational shaft of the first step motor 5, is screwed into a female screw hole 7 located at the center of the right and left moving table 2 on the right side thereof. With this arrangement, the right and left moving table 2 can be reciprocated right and left on the base 1 by the forward and backward rotation of the first step motor 5.

A forward and backward moving table 8 is placed on the upper surface of the right and left moving table 2 so as to be slidingly moved forward and backward (the upper and lower direction in FIG. 2) by the engagement of a pair of projections 9, which are located on both the sides of the lower surface of the forward and backward moving table 8, with concave grooves 10, which are formed on the upper surface of the right and left moving table 2.

A second step motor 12 is disposed on a support table 11 standing on the base 1 at a position backward of the forward and backward moving table 8. A screw shaft 13, which is coupled with the rotatable shaft of the second step motor 12, is screwed into a female screw hole 14 formed to the rear end of the forward and backward moving table 8 at the center thereof. With this arrangement, the forward and backward moving table 8 can reciprocate forward and backward on the right and left moving table 2 by the forward and backward rotation of the second step motor 12.

A support shaft 17 located on the lower surface of a turntable 16 at the center thereof is rotatably engaged with the bottomed support hole 15 formed on the upper surface of the forward and backward moving table 8 at the center thereof.

A table rotation motor 19 is disposed on the forward and backward moving table 8 located at a position rightward of the turntable 16, and a worm 20, which is coupled with the rotatable shaft of the table rotation motor 19, is meshed with a ring gear 21, which is fixed to the outer periphery of the turntable 16. With this arrangement, the turntable 16 can be rotated clockwise and counterclockwise in plane by the forward and backward rotation of the table rotation motor 19.

A cylindrical polishing drum 23, which is opened at both the right and left ends of it, is rotatably engaged with the hollow hole 22*a* of a hollow support block 22, which is fixed to the upper surface of the turntable 16 at the center thereof, through a pair of right and left bearings 24 provided with the support block 22. The inside diameter of the polishing drum 23 is set larger than the outside diameter of a semiconductor wafer 42.

A polishing drum drive motor 25 is disposed on the turntable 16, and the other end of a drive belt 26, one end of which is trained around the drive pulley of the motor 25, is wound around a follower pulley 27, which is fixed to the outer periphery of the polishing drum 23 on the left end thereof.

The polishing drum 23 can be rotated forward and backward about a horizontal axis by the operation of the polishing drum drive motor 25.

An abrasive cloth 28 such as a non-woven fabric cloth or the like is bonded to the inner periphery of the polishing drum 23.

The base end of a wafer rotation shaft 30, the axial line of which is tilted a prescribed angle in an obliquely forward and backward direction with respect to the axial line of the polishing drum 23, is rotatably supported by the upper end of a bearing stand 29 which stands on the base 1 at a position leftward of the right and left moving table 2. A suction type chuck 31 for fixing the wafer is attached to the extreme end, which can be inserted into the polishing drum 23, of the wafer rotation shaft 30.

A motor 33 for driving the wafer rotation shaft 30 is placed on the upper surface of a support table 32, which stands on the base 1 at a position leftward of the bearing stand 29. The other end of a drive belt 35, one end of which is trained around the drive pulley 34 of the motor 33, is wound around a follower pulley 36, which is fitted to the base end of the wafer rotation shaft 30.

The base end of a wafer support shaft 38 is supported coaxially with the wafer rotation shaft 30 by the upper end of a bearing stand 37, which stands on the base 1 at a position rightward of the right and left moving table 2, so that the wafer support shaft 38 rotates and slides in an axial direction.

A suction chuck 31 similar to the above suction chuck 31 is attached to the extreme end, which can be inserted into and removed from the polishing drum 23, of the wafer support shaft 38.

An air cylinder 40 is disposed on a support table 39, which stands on the base 1 at a position rightward of the bearing stand 37. A rotatable loader head 41 attached to the extreme end of the piston rod 40*a*, which is coaxial with the wafer support shaft 38, of the air cylinder 40 is abutted against the base end of the wafer support shaft 38 and presses it.

Next, how the outer periphery of the semiconductor wafer 42 as a workpiece is polished using the polishing apparatus will be described. As shown in an enlarged fashion in FIG. 3, the semiconductor wafer 42 has chamfered portions 42*a* each having a prescribed angle at both the ends of the outer periphery thereof and both the chamfered portions 42*a* are to be polished.

As shown in FIG. 1 and FIG. 2, first, the semiconductor wafer 42 is held and fixed by both the chucks 31 of the wafer rotation shaft 30 and the wafer support shaft 38. At the time, when the polishing drum 23 is moved leftward together with the right and left moving table 2 by driving the first step motor 5 as well as the wafer support shaft 38 is slidingly moved rightward by retracting the piston rod 40*a* of the air cylinder 40, the chucks 31 are located externally of the polishing drum 23. Thus, the semiconductor wafer 42 can be easily loaded and unloaded.

Figure 4:
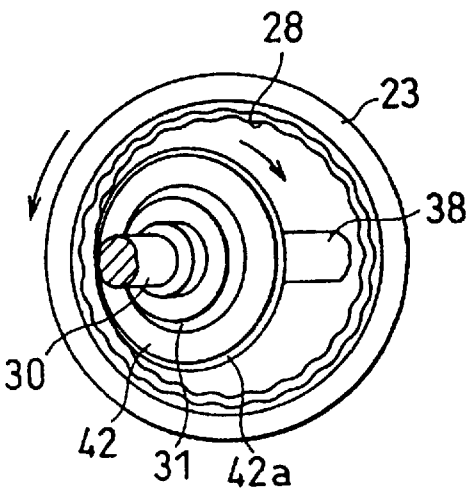
FIG. 4 is a fragmentary view of the main portions of the polishing drum and the workpiece from the direction of the line IV—IV in FIG. 3.
Figure 3:
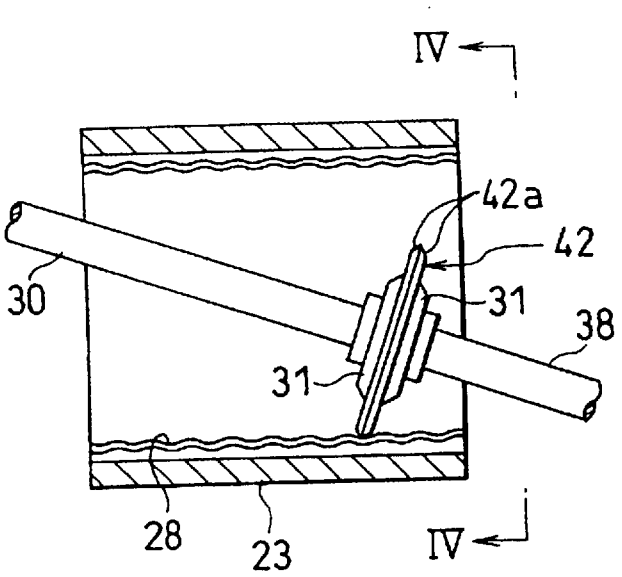
FIG. 3 is an enlarged plan view, laterally in cross section, of the main portion of a polishing drum of the present invention and the main portion of a workpiece.

After the semiconductor wafer 42 is chucked, the forward and backward moving table 8 is moved forward and backward by the second step motor 12. As shown in FIG. 3 and FIG. 4, the outer periphery of the semiconductor wafer 42 is thereby caused to come into contact with the inner periphery of the polishing drum 23 on the front side thereof, that is, with the inner surface of the abrasive cloth 28 bonded to the inner surface of the polishing drum 23 on the front side thereof.

Next, the turntable 16 is slightly rotated in any direction by driving the motor 19 so that the entire chamfered portion 42*a* of the semiconductor wafer 42 on one side of it reliably comes into sliding contact with the abrasive cloth 28.

The right and left moving table 2 is moved leftward in this state and the outer periphery of the semiconductor wafer 42 is caused to wait at a position near to the right end of the abrasive cloth 28 into which an abrasive agent is penetrated (the state shown in FIG. 3).

Next, the wafer rotation shaft 30 and the wafer support shaft 38 are rotated by driving the motor 33 to thereby rotate the semiconductor wafer 42. At the same time, the polishing drum 23 is rotated relatively to the wafer 42 in the direction opposite to that of the wafer 42 by driving the motor 25. Thereafter, the right and left moving table 2 and the polishing drum 23 placed above it are moved rightward so that the outer periphery of the semiconductor wafer 42 is moved in sliding contact with the abrasive cloth 28 to a position near to the left end of it. With this operation, the mirror polish of the chamfered portion 42*a* of the semiconductor wafer 42 on the one side thereof is finished.

Figure 6:
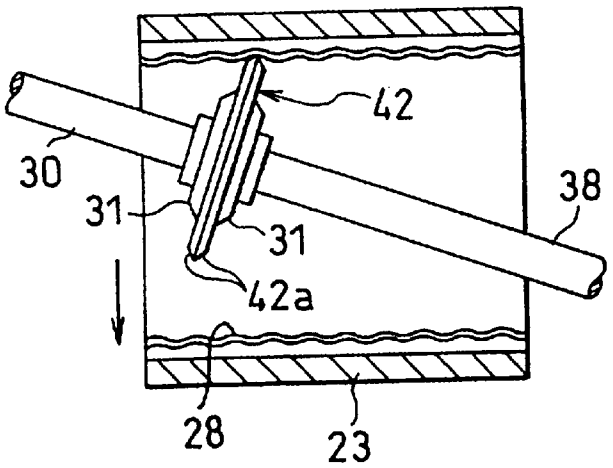
FIG. 6 is a plan view showing the state that the polishing drum is moved forward to polish a chamfered portion on an opposite side.

Next, as shown in FIG. 6, the polishing drum 23 is moved forward by moving the forward and backward moving table 8 forward. Thus, the chamfered portion 42*a* of the semiconductor wafer 42 on the opposite side thereof is caused to come into contact with the inner surface of the abrasive cloth 28 on the rear side thereof which confronts the abrasive cloth 28 on the front side thereof at 180° because the axial lines of the wafer rotation shaft 30 and the wafer support shaft 38 are tilted with respect to the axial line of the polishing drum 23.

Figure 7:
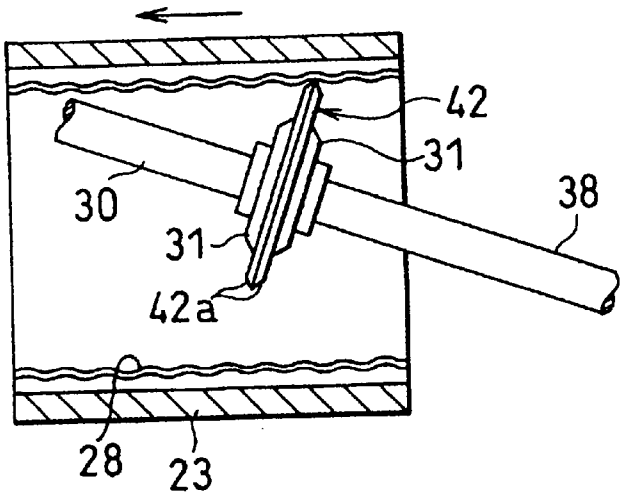
FIG. 7 is a plan view showing how the chamfered portion on the opposite side is polished.

When the right and left moving table 2 is moved leftward in this state and the polishing drum 23 is moved leftward as shown in FIG. 7, the chamfered portion 42*a* on the opposite side can be mirror finished.

Figure 5:
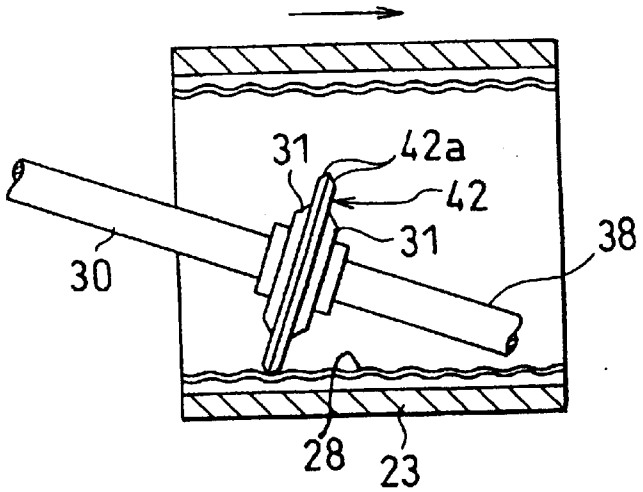
FIG. 5 is a plan view showing how a chamfered portion on one side is polished by the method of the present invention.

As described above, the chamfered portions 42*a* on both the sides of the semiconductor wafer 42 can be continuously mirror polished only by moving the polishing drum 23 in the directions of the arrows shown in FIG. 5 to FIG. 7 by moving the right and left moving table 2 and the forward and backward moving table 8.

Figure 8:
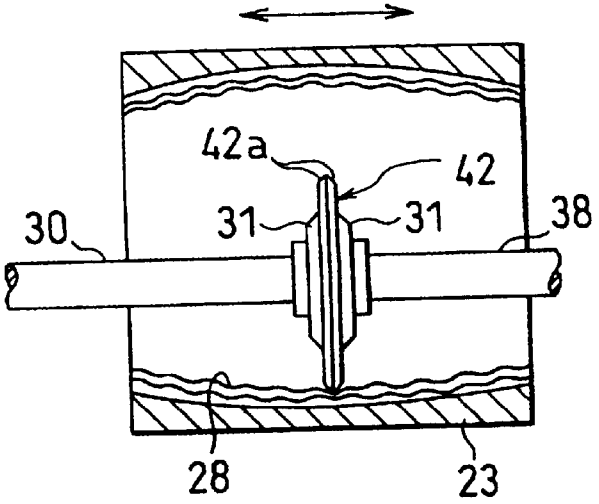
FIG. 8 is a plan view showing a second embodiment of the polishing drum and how polishing is carried out by the second embodiment.

FIG. 8 shows a second embodiment of the present invention, wherein the shape of the inner periphery of the polishing drum 23 and the shape of the abrasive cloth 28 bonded to the inner periphery of it are formed to a concave shape which has a small diameter on both the ends thereof and has a large diameter at the center thereof.

With the above shape, the chamfered portions 42*a* of the semiconductor wafer 42 on both the sides thereof can be simultaneously polished by only causing the axial line of the polishing drum 23 to be in parallel with the axial line of the wafer rotation shaft 30 by the rotation of the turntable 16 and by only reciprocating the polishing drum 23 right and left together with the right and left moving table 2.

Figure 9:
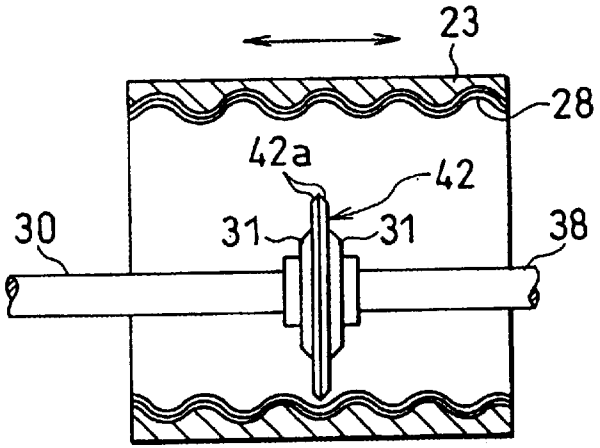
FIG. 9 is a plan view showing a third embodiment of the polishing drum and how polishing is carried out by the third embodiment.

FIG. 9 shows a third embodiment of the present invention, wherein the inner periphery of the polishing drum 23 and the abrasive cloth 28 bonded to the inner periphery of it are formed to a wave shape.

With the above shape, the chamfered portions of the semiconductor wafer 42 on both the sides of it can be simultaneously polished only by reciprocating the polishing drum 23 which is parallel with the axial line of the wafer rotation shaft 30 likewise the second embodiment.

Figure 10:
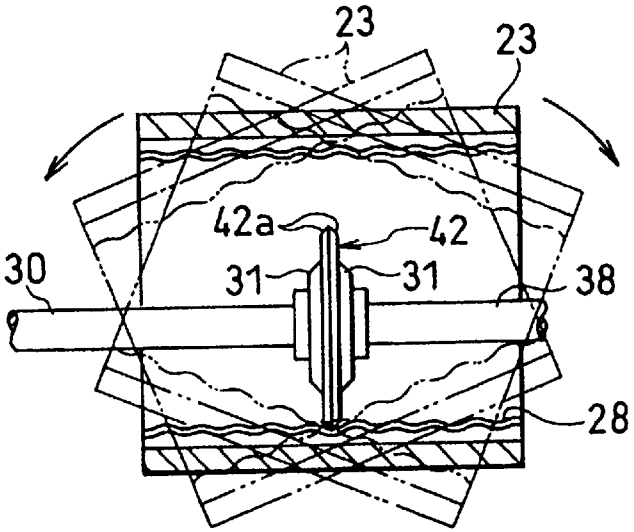
FIG. 10 is a plan view showing another polishing method of the present invention.

FIG. 10 shows another polishing method of the present invention. According to the method, the turntable 16 is reciprocatingly rotated a prescribed angle clockwise and counterclockwise in plane, and the polishing drum 23 placed on it is alternately rotated horizontally as shown by an imaginary line.

With this operation, since the abrasive cloth 28 alternately comes into contact with the both the chamfered portions 42*a* of the semiconductor wafer 42, the chamfered portions 42*a* can be simultaneously polished thereby.

Figure 11:
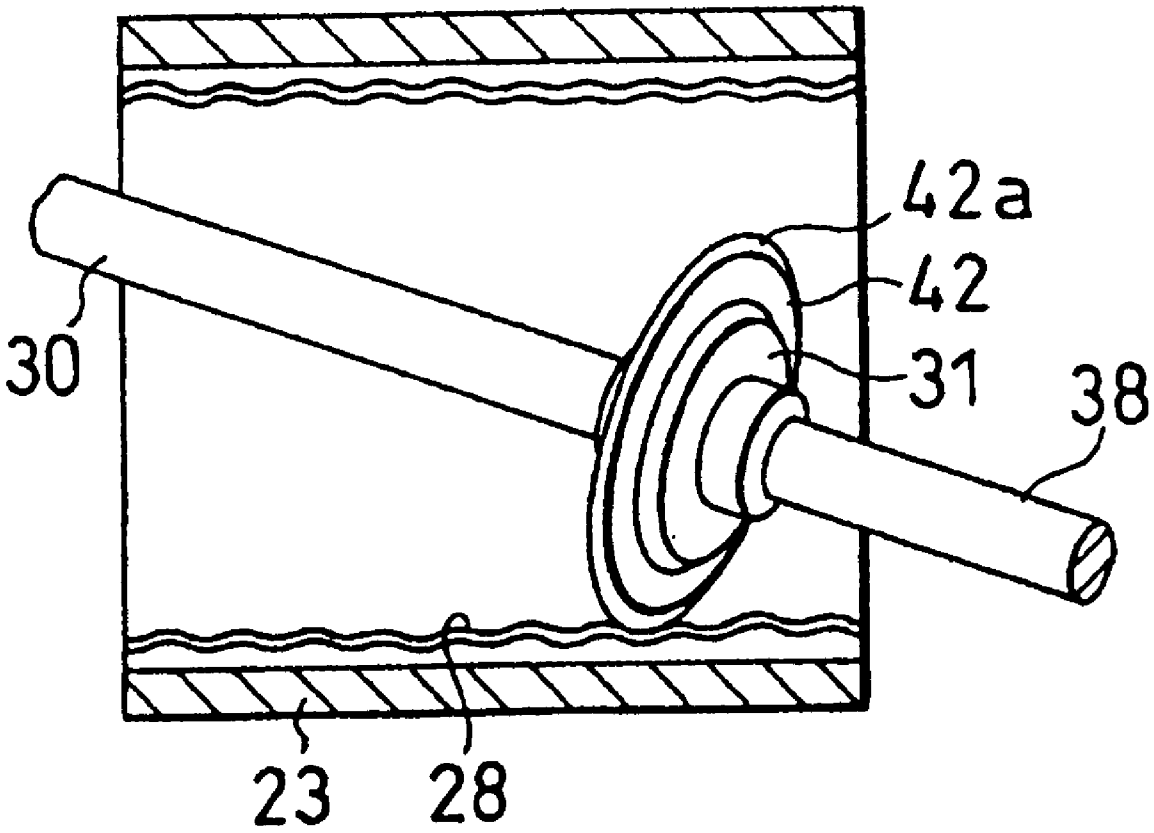
FIG. 11 is a plan view showing still another polishing method of the present invention.

FIG. 11 shows still another polishing method of the present invention, wherein the wafer rotation shaft 30 and the wafer support shaft 38 are further tilted a prescribed angle in an obliquely upward and downward direction from the state of them shown in FIG. 3, that is, from the state that they are tilted in the obliquely froward and backward direction with respect to the axial line of the polishing drum 23.

When the chamfered portions 42*a* of the semiconductor wafer 42 is polished by the above method, the outer periphery of the semiconductor wafer 42 comes into plane contact with the abrasive cloth 28 through a certain width (area) in place of that it comes into line contact therewith. As a result, the contact force of the abrasive cloth 28 is increased when the abrasive cloth 28 is relatively rotated with respect to the wafer 42, whereby the polishing efficiency of the chamfered portions 42*a* can be improved.

As described above, according to the method of the present invention, the chamfered portions 42*a* of the semiconductor wafer 42 are mirror-polished in the polishing drum 23 by means of the abrasive cloth 28 bonded to the inner periphery of the polishing drum 23. Accordingly, the region where the chamfered portion 42*a* is in contact with the abrasive cloth 28 in a peripheral direction is greatly increased as compared with that in the conventional method, whereby polishing efficiency can be improved and a polishing time can be reduced.

Further, in the semiconductor wafer 42 having the chamfered portions 42*a* on both the sides of the outer periphery of it, both the chamfered portions 42*a* can be continuously polished by moving the polishing drum 23 forward, backward, right and left, by changing the shape of the inner periphery of the polishing drum 23, or by horizontally rotating the polishing drum 23. Therefore, the wafer 42 which has been chucked once need not be rechucked, whereby working efficiency can be improved and productivity can be greatly increased.

The present invention is by no means limited to the above embodiments.

In the apparatus of the above embodiment, the wafer rotation shaft 30 and the wafer support shaft 38 are previously tilted in the obliquely forward and backward direction by supposing the case that the turntable 16 is not operated. Thus, when the turntable 16 is rotated and the polishing drum 23 is horizontally rotated as shown in FIG. 10, the axial line of the wafer rotation shaft 30 need not be tilted and may be parallel with the axial line of the polishing drum 23.

In addition, when the wafer rotation shaft 30 is tilted as in the embodiment or when the shape of the inner periphery of the polishing drum 23 is changed as shown in FIG. 8 and FIG. 9, the turntable 16 is not always needed and the polishing apparatus may be embodied without the turntable 16.

In the above embodiments, the support members for the semiconductor wafer 42 are unmovable and the support members for polishing drum 23 are movable forward, backward, right and left as well as also rotatable. However, the former support members may be movable and the above latter support members may be unmovable because the semiconductor wafer 42 moves relatively to the polishing drum 23.

In the embodiments, while the polishing drum 23 and the semiconductor wafer 42 are rotated relatively to each other, any one of them may be rotated.

In the above description, the semiconductor wafer 42 of the embodiments has the chamfered portions 42*a* on both the sides thereof, it is needless to say that the present invention is applicable to the polishing of the semiconductor wafer 42 which is provided with the chamfered portion 42*a* only on the one side thereof, to the semiconductor wafer 42 without the chamfered portion, and to the semiconductor wafer 42 provided with a curved chamfered portion. At the time, the shape of the inner periphery of the polishing drum 23 and the shape of the abrasive cloth 28 bonded to the inner periphery of it may be suitably set.

The present invention is also applicable to the polishing of other disc-shaped workpieces in addition to the polishing of the semiconductor wafer 42.

According to the method and apparatus of the present invention, there can be obtained the following effects.

(a) The outer periphery of a workpiece is polished in contact with the abrasive material in the cylindrical polishing drum, the region where the outer periphery of the workpiece comes into contact with the abrasive material is increased as compared with the conventional method, whereby polishing efficiency can be increased.

(b) With the arrangement as disclosed in a second aspect of the invention, since the abrasive material is uniformly worn, its life can be increased.

(c) With the arrangement as disclosed in third and fourth aspects of the invention, the chamfered portions on both the sides of the outer periphery of a workpiece can be continuously polished without the need of rechucking the workpiece which has been chucked once, whereby working efficiency and productivity can be improved.

(d) With the arrangement as disclosed in a fifth aspect of the invention, the contact force of the abrasive material which is in contact with the outer periphery of the workpiece is increased, whereby the polishing efficiency can be more improved.

(e) With the apparatus according to sixth to ninth aspects of the invention, the methods of the respective aspects of the invention can be easily embodied by a relatively simple arrangement.

(f) With the arrangement as disclosed in tenth and eleventh aspects of the invention, the chamfered portions of both the sides of the outer periphery of a workpiece can be simultaneously polished only by relatively moving any one of the polishing drum and a workpiece simply in an axial direction.

What is claimed is:

1. A method for polishing the outer periphery of a disc-shaped workpiece, comprising the steps of:

accommodating the disc-shaped workpiece supported by a support shaft in a cylindrical polishing drum having an abrasive material disposed to the inner periphery of it; and polishing the outer periphery of the workpiece by relatively rotating the polishing drum and the workpiece while causing at least a part of the outer periphery of the workpiece to come into contact with the abrasive material, the axial line of the polishing drum and the workpiece support shaft are tilted with respect to one another a prescribed angle so that the outer periphery of the workpiece alternately comes into contact with both the inner peripheries of the abrasive material which confront each other at approximately 180°.

2. A method for polishing the outer periphery of a disc-shaped workpiece according to claim 1, wherein the outer periphery of the workpiece is polished while relatively moving the polishing drum and the workpiece in the axial direction of the polishing drum.

3. A method for polishing the outer periphery of a disc-shaped workpiece comprising the steps of:

accommodating the disc-shaped workpiece supported by a support shaft in a cylindrical polishing drum having an abrasive material disposed to the inner periphery of it; and polishing the outer periphery of the workpiece by relatively rotating the polishing drum and the workpiece while causing at least a part of the outer periphery of the workpiece to come into contact with the abrasive material, wherein the outer periphery of the workpiece is polished by alternately tilting any one of the axial line of the polishing drum and the workpiece support shaft with respect to the other of them a prescribed angle.

4. A method for polishing the outer periphery of a disc-shaped workpiece comprising the steps of:

accommodating the disc-shaped workpiece supported by a support shaft in a cylindrical polishing drum having an abrasive material disposed to the inner periphery of it; and polishing the outer periphery of the workpiece by relatively rotating the polishing drum and the workpiece while causing at least a part of the outer periphery of the workpiece to come into contact with the abrasive material, wherein the outer periphery of the workpiece is polished by tilting any one of the axial line of the polishing drum and the workpiece support shaft so that a part of the outer periphery of the workpiece is in plane contact with the abrasive material.

5. A polishing apparatus for polishing the outer periphery of a disc-shaped workpiece, comprising:

a cylindrical polishing drum having an abrasive material disposed to the inner periphery of it;

a workpiece holding member attached to a proper position of a support shaft so as to be inserted into and removed from the polishing drum;

a drive means for relatively rotating any one of at least the polishing drum and the workpiece holding member; and a rotating means for relatively horizontally rotating the polishing drum relative to the support shaft.

6. A polishing apparatus for polishing the outer periphery of a disc-shaped workpiece according to claim 5, comprising a moving means for relatively moving one of the polishing drum and the support shaft in the axial direction of the polishing drum.

7. A polishing apparatus for polishing the outer periphery of a disc-shaped workpiece according to claim 5, comprising a moving means for relatively moving any one of the polishing drum and the support shaft in a direction perpendicular to the axis of the polishing drum.

8. A polishing apparatus for polishing the outer periphery of a disc-shaped workpiece according to claim 5, wherein the abrasive material disposed to the inner periphery of the polishing drum has an inner periphery formed to a waveform.

9. A polishing apparatus for polishing the outer periphery of a disc-shaped workpiece according to claim 5, wherein the abrasive material disposed to the inner periphery of the polishing drum has an inner peripheral shape having a small diameter on both the ends of it and a large diameter at the central portion of it.

10. A polishing apparatus for polishing the outer periphery of a disc-shaped workpiece comprising:

a cylindrical polishing drum having an abrasive material disposed to the inner periphery of it;

a workpiece holding member attached to a proper position of a support shaft so as to be inserted into and removed from the polishing drum; and a drive means for relatively rotating any one of at least the polishing drum and the workpiece holding member; wherein the abrasive material disposed to the inner periphery of the polishing drum has an inner peripheral shape having a small diameter on both the ends of it and a large diameter at the central portion of it.

11. A polishing apparatus for polishing the outer periphery of a disc-shaped workpiece according to claim 10, comprising a moving means for relatively moving one of the polishing drum and the support shaft in the axial direction of the polishing drum.

12. A polishing apparatus for polishing the outer periphery of a disc-shaped workpiece according to claim 10, comprising a second moving means for relatively moving any one of the polishing drum and the support shaft in a direction perpendicular to the axis of the polishing drum.

13. A polishing apparatus for polishing the outer periphery of a disc-shaped workpiece according to claim 10, comprising a rotating means for relatively horizontally rotating any one of the polishing drum and the support shaft.

14. A polishing apparatus for polishing the outer periphery of a disc-shaped workpiece according to claim 10, wherein the abrasive material disposed to the inner periphery of the polishing drum has an inner periphery formed to a waveform.

* * * * *